US005309798A

United States Patent [19]

Markwart et al.

[11] Patent Number: 5,309,798

[45] Date of Patent: May 10, 1994

[54] TOOL BIT RETAINING ASSEMBLY

[75] Inventors: Ronald Markwart, Burnaby; Leslie Markwart, North Burnaby, both of Canada

[73] Assignee: Inno-Ware Enterprises Limited, Burnaby, Canada

[21] Appl. No.: 32,495

[22] Filed: Mar. 17, 1993

[51] Int. Cl.[5] ..... B25B 23/00

[52] U.S. Cl. ..... 81/438; 81/177.85; 279/79; 403/327; 403/DIG. 6

[58] Field of Search ..... 81/125, 177.85, 177.2, 81/438; 279/76, 79; 403/109, 326, 327, DIG. 6

[56] References Cited

U.S. PATENT DOCUMENTS

| | | | |
|---|---|---|---|
| 3,005,367 | 10/1961 | Vose | 87/125 |
| 3,151,512 | 10/1964 | Charczenko | 81/438 X |
| 3,347,293 | 10/1967 | Clark | 81/438 |
| 4,535,658 | 8/1985 | Molinari | 81/438 X |

*Primary Examiner*—James G. Smith

*Attorney, Agent, or Firm*—Vinson & Elkins

[57] ABSTRACT

A tool bit retaining assembly for a tool of a type having a tool bit receptacle and a spring receiving region with a hole opening into the receptacle and a tool bit insertable into the receptacle. The tool bit has a transverse groove proximate an insertion end thereof, and includes a ball bearing with a diameter only slightly larger than that of the hole such that upon being pressed against the hole the ball bearing extends through the hole into the receptacle and engages the transverse groove in said tool bit. A split ring spring having a split extending from one end to the other with a portion transverse to the axis thereof is positionable around said spring receiving region such that the transverse portion of the split is opposite the ball bearing. The spring also has a hole on a side opposite the split of a diameter smaller than that of the ball bearing, such that with the hole in the spring against the ball bearing, the latter is pressed against the hole in the tool and engages a tool bit groove of a tool bit positioned in the receptacle.

12 Claims, 3 Drawing Sheets

Fig 4
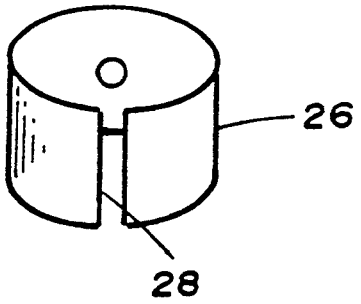
Fig 5
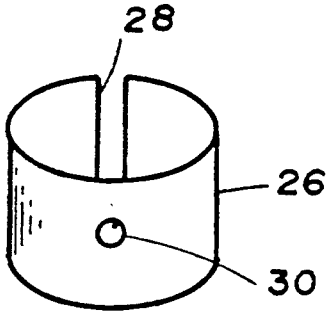
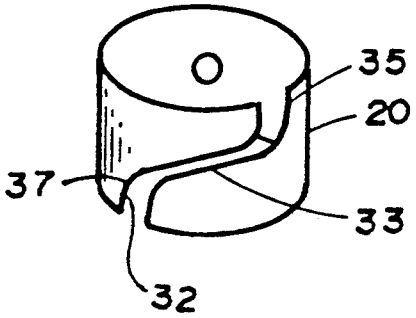
Fig. 6
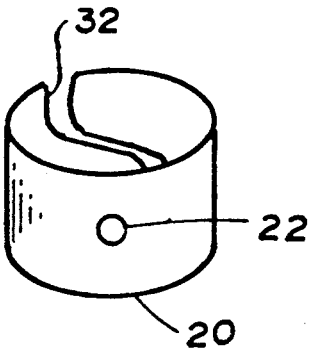
Fig. 7

TOOL BIT RETAINING ASSEMBLY

BACKGROUND

The present invention relates to an assembly for retaining a removable tool bit in place while at the same time allowing it to be manually removed against a biasing force applied to the tool bit by the assembly.

Removable tool bit assemblies must be capable of accommodating rapid insertion and removal of the tool bit without the need for screwing and unscrewing locking assemblies or imparting any other time consuming operation in order to retain and remove the tool bit. One solution as disclosed by U.S. Pat. No. 4,924,733 is to use a magnet in the nosepiece abutting an end of the tool bit when inserted. However, the magnet constitutes and additional expense and assembly step to install. Moreover, magnets can lose their strength and become ineffective, particularly when the make contact only with the pointed end of the bit.

Another common arrangement is a receptacle in a shaft or nose piece into which the bit is inserted until a notch in the tool aligns with a hole in the shaft. A ball bearing slightly larger than the hole in the shaft is held against the hole and extends through the latter to engage the notch by a spring that is held against the ball bearing. The spring is in the form of a split ring with a hole opposite the split so as to impede movement of the ring relative to the ball. One problem with such a device is that the ring often slips off of the ball bearing and turns to the degree that the split straddles the ball bearing. At the latter point it is often the case that the ball will squeeze through the split, drop to the ground and become lost. The screwdriver thus becomes inoperative.

Accordingly, it is an object of the invention to provide an improved assembly for releasably holding a tool bit in place.

SUMMARY OF THE INVENTION

According to the invention there is provided a tool bit retaining assembly for a tool of a type having a tool bit receptacle and a spring receiving region with a hole opening into the receptacle and a tool bit insertable into the receptacle. The tool bit has a transverse groove proximate an insertion end thereof, and includes a ball bearing with a diameter only slightly larger than that of the hole such that upon being pressed against the hole the ball bearing extends through the hole into the receptacle and engages the transverse groove in said tool bit. A split ring spring having a split extending from one end to the other with a portion substantially transverse to the axis thereof is positionable around said spring receiving region such that the transverse portion of the split is opposite the ball bearing. The spring also has a hole on a side opposite the split of a diameter smaller than that of the ball bearing, such that with the hole in the spring against the ball bearing, the latter is pressed against the hole in the tool and engages a tool bit groove of a tool bit positioned in the receptacle.

Preferably the split has the transverse portion midway along the length of said spring. Advantageously, the tool includes a handle, a nosepiece inserted into the handle. with the tool bit receptacle located in an end of said nosepiece. The spring receiving region may be located on the nosepiece proximate a distal end thereof.

The transverse portion of the split may be midway along the length of said spring. Moreover, a surface of the spring receiving region may be roughened with tiny sharp protrusions so as to impede said spring from turning around a surface of the region.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

FIG. 4 is a perspective view of a conventional retainer spring;

FIG. 5 is a perspective view of the opposite side of the retainer spring shown in FIG. 4;

FIG. 6 is a perspective view of a preferred embodiment of the spring of the present invention; and FIG. 7 is a perspective view of the opposite side of the spring shown in FIG. 6.

DETAILED DESCRIPTION WITH REFERENCE TO THE DRAWINGS

Figures 1, 2:
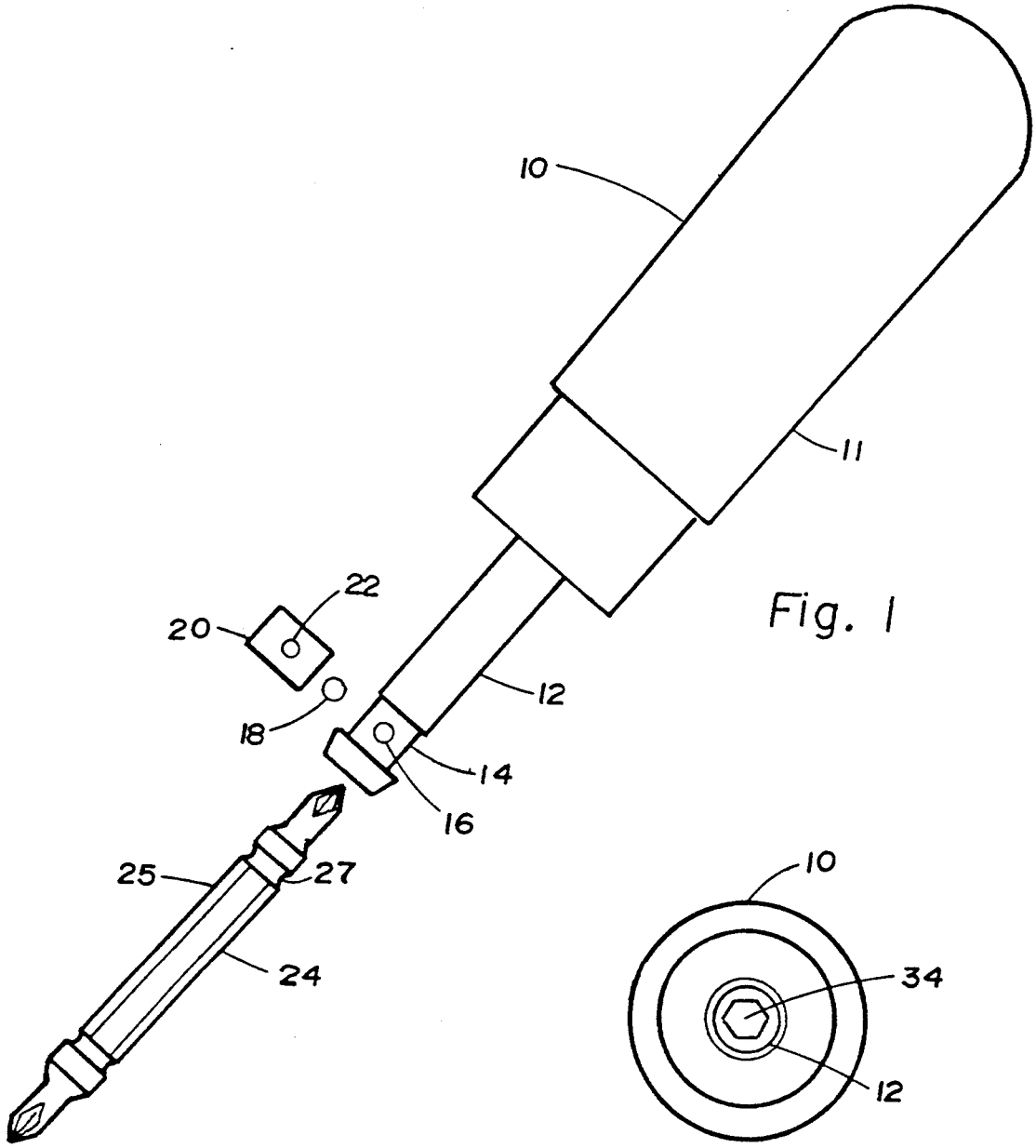
FIG. 1 is an elevation view of a screwdriver with the tool bit and tool bit retainer assembly exploded.
FIG. 2 is an end view of the nosepiece end of the screwdriver.

Referring to FIG. 1 there is shown a screwdriver 10 having a handle 11 into one end of which is affixed a nosepiece 12. The nosepiece 12 has a recessed portion 14 of narrower diameter near the end thereof. As shown in FIG. 2, a hexagonal receptacle 34 is formed in the nosepiece for receiving a tool bit 24 having a hexagonal shank 25. The tool bit 24 has a transverse groove 27 near an end thereof. The recessed portion 14 has a roughened surface and a hole 16 opening into the receptacle 34. A ball bearing 18 is dimensioned to fit into the hole 16 and when pressed against the latter extends into receptacle 34 and engages groove 27. Spring 20 has a hole 22 smaller in diameter than the ball bearing 18. With the spring fitted over the recess 14 with hole 22 aligned with the ball bearing 18 and the latter positioned against hole 16, the tool bit 24 when inserted is held in place by the spring pressure against the ball bearing 18.

Figure 3:
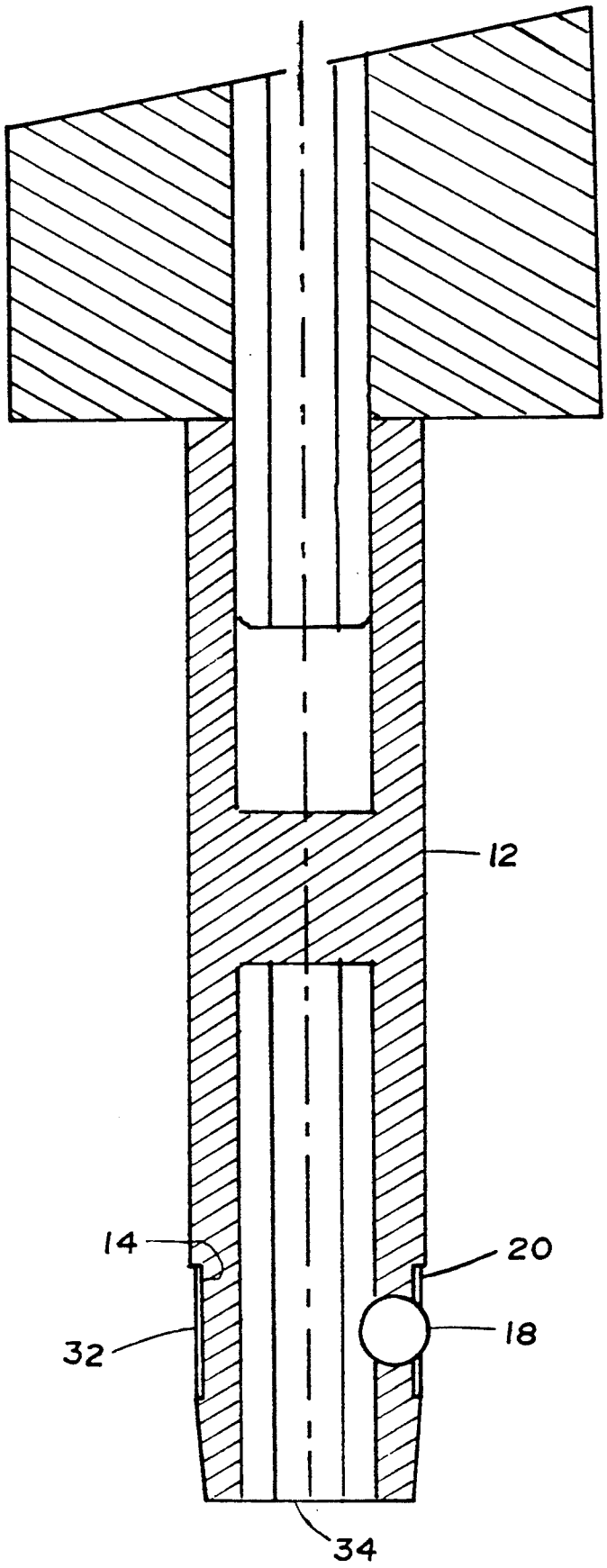
FIG. 3 is a partial sectional view of the nosepiece of the screwdriver.

A more detailed view of the positioning of the spring 20, the ball bearing 18 vis-a-vis the nosepiece 12 is seen in FIG. 3.

FIGS. 4 and 5 show a conventional split ring spring 26 having a split 28 parallel to an axis of the spring 26 and a hole 30 on an opposite side of the split 28. In this case if the hole 30 slips away from the ball bearing 18 it will shift until split 28 aligns with the ball bearing 18. At that point the pressure of the spring against the ball bearing will cause the split to widen and permit the ball bearing 18 to fall out.

FIGS. 6 and 7 show a preferred embodiment of the spring in accordance with the present invention. The split 32 in this case has a serpentine shape with a transverse portion 33 along the centre joining two generally vertical portions 35 and 37. In this case if the spring were to shift so that hole 22 slid past ball bearing 18 even if the transverse portion 33 of the split were to align against the ball bearing, the space between the edges of the transverse portion 33 of the split would not widen. They would merely move parallel and in opposite directions to each other. Thus, the ball bearing would not fall out.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modification or embodiments as fall within the true scope of the invention.

I claim:

1. A tool bit retaining assembly for a tool of a type having a tool bit receptacle and a spring receiving region with a hole opening into the receptacle and a tool bit insertable into receptacle and the tool bit having a transverse groove proximate an insertion end thereof, comprising:

(a) a ball bearing having a diameter only slightly larger than that of the hole such that upon being pressed against the hole the ball bearing extends through the hole into the receptacle and engages the transverse groove in said tool bit;

(b) a split ring spring having a split extending from one end to the other with a portion substantially transverse to the axis thereof and positionable around said spring receiving region such that the transverse portion of the split is opposite the ball bearing, said spring also having a hole on a side opposite the split of a diameter smaller than that of the ball bearing, such that with the hole in the spring against the ball bearing, the latter is pressed against the hole in the tool and engages a tool bit groove of a tool bit positioned in the receptacle.

2. An assembly according to claim 1, such that the split has the transverse portion midway along the length of said spring.

3. An assembly according to claim 1, including a handle, a nosepiece inserted into said handle, with the tool bit receptacle located in an end of said nosepiece, and the spring receiving region located on the nosepiece proximate a distal end thereof.

4. An assembly according to claim 3 wherein a surface of the spring receiving region is roughened with tiny sharp protrusions so as to impede said spring from turning around a surface of said region.

5. A tool having a tool bit receptacle, comprising:

(a) a spring receiving region on said tool having a hole opening into the receptacle;

(b) a tool bit insertable into the tool bit receptacle and having a substantially transverse groove near an insertion end thereof;

(c) a ball bearing having a diameter only slightly larger than the hole such that upon being pressed against the hole the ball bearing extends through the hole into the receptacle and engages the transverse groove in said tool bit;

(d) a split ring spring having a split extending from one end to the other with a portion transverse to the axis thereof and positionable around said spring receiving region such that the transverse portion of the split is opposite the ball bearing, said spring also having a spring hole on a side opposite the split of a diameter smaller than that of the ball bearing, such that with the spring hole in the spring against the ball bearing, the latter is pressed against the hole in the tool and engages a tool bit groove of a tool bit positioned in the receptacle.

6. A tool according to claim 5, wherein said spring receiving region has a roughened surface to restrain said spring from turning.

7. A tool according to claim 6, wherein the transverse portion of the split is midway along the length of said spring.

8. A tool according to claim 5, including a handle and a nosepiece inserted into said handle and said receiving region is a region of slightly narrower cross sectional dimensions than a surrounding region of said nosepiece.

9. A tool having a handle, a nosepiece inserted into said handle and a tool bit receptacle in an end of said nosepiece, comprising:

(a) a spring receiving region on said nosepiece having a nosepiece hole opening into the receptacle;

(b) a tool bit insertable into the tool bit receptacle and having a transverse groove near an insertion end thereof;

(c) a ball bearing having a diameter only slightly larger than the nosepiece hole such that upon being pressed against the nosepiece hole the ball bearing extends through the nosepiece hole into the receptacle and engages the transverse groove in said tool bit;

(d) a split ring spring having a split extending from one end to the other with a portion substantially transverse to the axis thereof and positionable around said spring receiving region such that the transverse portion of the split is opposite the ball bearing, said spring also having a spring hole on a side opposite the split of a diameter smaller than that of the ball bearing, such that with the spring hole against the ball bearing, the latter is pressed against the nosepiece hole in the tool and engages a tool bit groove of a tool bit positioned in the receptacle.

10. A tool according to claim 9, wherein said spring receiving region has a cylindrical outer surface of slightly smaller diameter than the width of the remainder of the nosepiece and the outer surface of said region is roughened to impede any tendency of the spring to turn.

11. A tool according to claim 10, wherein said transverse portion of the split is midway along the length of said spring and aligned transversely with the spring hole.

12. A tool according to claim 9, wherein said spring split includes a longitudinally extending split on either end of said spring joining opposite ends of the transverse portion of the spring.

* * * * *